US006010376A

United States Patent [19]

Kollmann

[11] Patent Number: 6,010,376

[45] Date of Patent: Jan. 4, 2000

[54] CONNECTORS FOR ELECTRICAL CONDUCTORS

[75] Inventor: Hans-Josef Kollmann, Minden, Germany

[73] Assignee: WAGO Verwaltungsgesellschaft GmbH, Minden, Germany

[21] Appl. No.: 08/927,512

[22] Filed: Sep. 11, 1997

[30] Foreign Application Priority Data

Sep. 25, 1996 [DE] Germany ..... 196 41 206

[51] Int. Cl.[7] ..... H01R 4/48

[52] U.S. Cl. ..... 439/834; 439/803

[58] Field of Search ..... 439/775, 776, 439/786, 787, 803, 806, 809, 816, 817, 822, 828, 834, 836

[56] References Cited

U.S. PATENT DOCUMENTS 5,816,867 10/1998 Davidsz et al. ..... 439/828

*Primary Examiner*—Lincoln Donovan
*Attorney, Agent, or Firm*—Salter & Michaelson

[57] ABSTRACT

A connector for electrical conductors with at least one spring-force clamped connection in the form of a loop-shaped bent clamping spring. The task is to reduce as much as possible the structural height of the clamping spring measured crosswise to the direction for introducing the conductor. This is achieved by lowering the curved spring piece of the clamping spring, which is arranged in a recessed position in an adapted recess, shaped cavity, or the like, of the respective bus bar.

8 Claims, 1 Drawing Sheet

Fig. 2
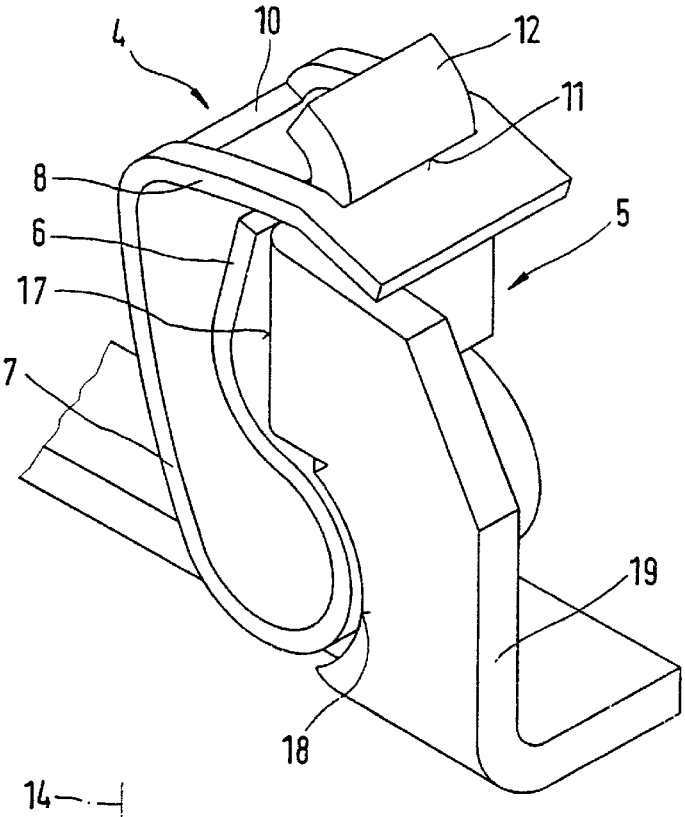
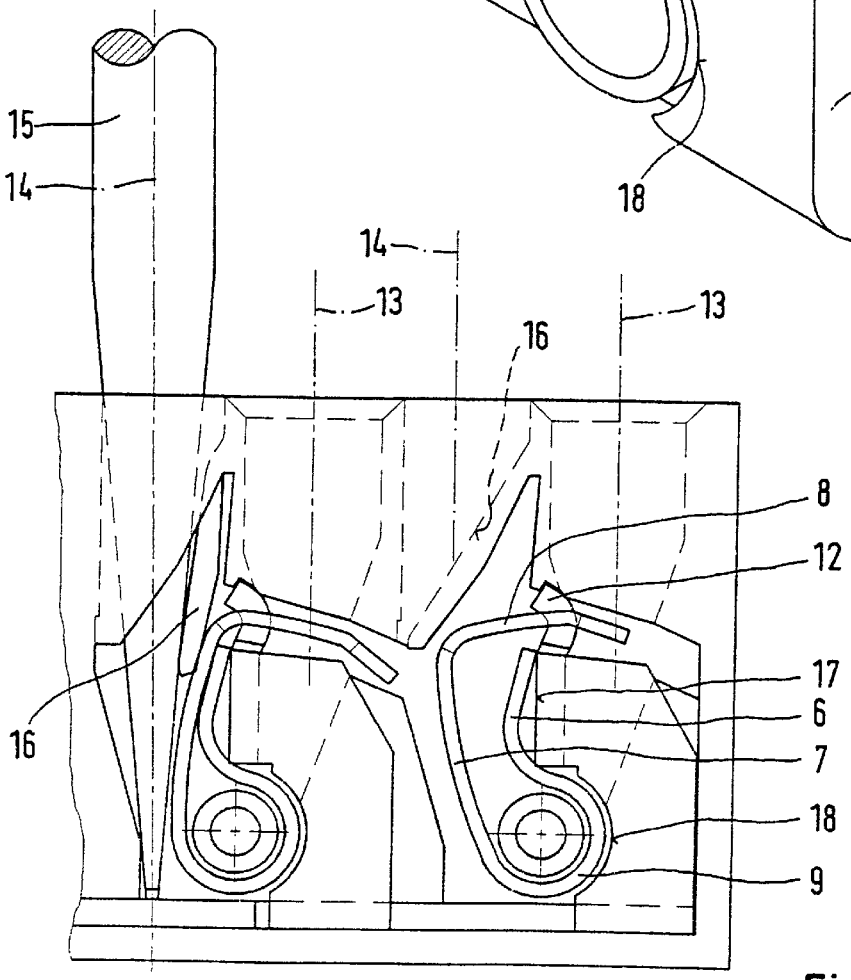
Fig. 1

CONNECTORS FOR ELECTRICAL CONDUCTORS

BACKGROUND OF THE INVENTION

The invention concerns a connector for electrical conductors with at least one clamped connection, the connector comprising a bus bar with clamping spring shaped of a flat spring material in a type of loop. The clamping spring has a contact branch applied to the bus bar and a clamping branch extending crosswise to the bus bar and bent off from the back part of the clamping spring. The clamping spring further has a curved backward spring piece which joins the back part and the contact branch. The clamping branch is provided with a clamping recess, by means of which the head end of the bus bar is extended out in such a way that the lower edge of the clamping recess rigidly clamps an electrical conductor introduced between the underside of the bus bar and the lower edge of the clamping recess in the clamping recess against the underside of the bus bar.

Connectors of this type are known, for example, from DE 3,727,091 C1 or DE 4,237,733 C1. Their structural height measured crosswise to the direction of introducing the conductor is essentially determined by the structural installation of the bus bar and the clamping spring mounted on the bus bar. In addition, the actuating devices for opening the clamped connection require an additional structural height depending on the type of actuation device. These structural heights add up in connectors with several clamped connections, so that space problems result in several cases of application.

SUMMARY OF THE INVENTION

The object of the invention is to propose a structure for clamped connections for connectors of the type defined above, which is built very small relative to the structural height measured crosswise to the direction of introducing the conductor.

The invention proceeds from the fact that the curved spring of the clamping spring, which claims an essential part of the structural height of a clamped connection cannot be made smaller in principle, since the spring characteristics of this spring are essentially determined by the curved spring piece. However, according to the instructions of the invention, the curved spring piece can be shaped such that it is recessed proceeding from the back part of the clamping spring at least by a part of its curvature to below a contact plane defined by extending the contact branch of the clamping spring, whereby the bus bar has a corresponding recess or shaped cavity or the like in the region of the curved spring piece of the clamping spring, in which the curved spring piece of the clamping spring is arranged in a recessed position.

As will be explained in more detail below on the basis of the drawings, a preferred form of embodiment of the invention provides that the curved spring piece of the clamping spring is recessed by approximately half of its diameter to below the contact plane.

A further reduction of the structural height of the clamped connection of the above-named type is achieved in that the clamping recess in the clamping branch of the clamping spring, which defines the maximum stroke motion of the clamping branch of the clamping spring by its upper and lower edges in combination with the head end of the bus bar, which extends through the clamping recess, is positioned differently than is usual in the clamped connection of this type previously known. It is proposed to position the clamping recess in the clamping branch of the clamping spring in such a way that its upper edge is arranged directly below the back part of the clamping spring.

It is achieved by this measure that the upper contour of the transition of the clamping branch into the back part of the clamping spring is arranged closer to the bus bar for a maximally opened clamped connection, whereby the installation height of the clamped connection is reduced still further.

It is also appropriate to shape the back part of the clamping spring in an essentially flat manner, so that it is also found next to the bus bar when the clamped connection is opened.

It is further advantageous to shape the contact branch of the clamping spring, which contacts the bus bar, in such a way that it contacts the underside of the back part of the clamping spring in a space-saving manner when the clamped connection is opened.

BRIEF DESCRIPTION OF THE DRAWINGS

An example of embodiment of the invention will be described in more detail in the following description on the basis of the drawings. Here:

FIG. 1 shows a connector with two clamped connections in a lateral view; and FIG. 2 shows a clamped connection according to FIG. 1 in a perspective representation.

DETAILED DESCRIPTION OF THE PREFERRED EMBODIMENT

A connector, which is shown in FIG. 1, has two clamped connections 22*a* and 22*b*, which are designed in a structurally similar manner. Each clamped connection comprises a clamping spring 4 shaped in a type of loop and a specially shaped bus bar 5 (see FIG. 2).

Individually, the clamping spring 4 has a contact branch 6 applied to the bus bar, a clamping branch 8 extended crosswise to the bus bar and bent off from a back part 7 of clamping branch 8 of the clamping spring, as well as a curved spring piece or bow 9 connecting the back part 7 and the contact branch 6. The clamping branch 8 has a clamping aperture 20 with an upper crosswise edge 10 and a lower clamping edge 11 (see FIG. 2). A head end 12 of the bus bar 5 extends through this clamping aperture 20 in the manner shown in FIG. 2.

The insulation housing 24 includes a mounting core 26 associated with each clamped connection 22*a* and 22*b*. Each clamp spring 4 is mounted on its respective mounting core 26 in such a way that its curved spring piece or bow 9 encircles at least 180° of the outer surface of the mounting core 26. The insulation housing 2 of the clamped connection represented in FIG. 1 has a conductor opening 13 formed therein along conductor axis 13*a* for receiving a conductor 28 for each clamped connection and an actuation opening 14 along axis 14*a*. When the clamping connection is opened (see the clamping connection 22*a* in FIG. 1), an electrical conductor (not shown) can be introduced through the conductor opening 13 into the clamping position, which is formed between the head end 12 of the bus bar and the clamping edge 11 of the clamping aperture 20 of clamping branch 8 in a manner to be described below. Clamping edge 11 pulls the electrical conductor against the underside of the bus bar upon closing the clamping connection.

In order to open the clamped connection, in the case of the example of the embodiment that is shown, the blade of a screwdriver 15 is introduced axially into the actuation opening 14. The tip of the blade presses an insulation guide piece 16 against the back part 7 of the clamping spring, so that the blade of the screwdriver is driven without problem into its feed channel behind the back part 7 of the clamping spring. In this way, the back part of the clamping spring with clamping branch 8 is moved into the opened position of the clamped connection. This is shown for the clamped connection 22*a* in FIG. 1.

According to the invention, the curved spring piece 9 of the clamping spring 4 is shaped in such a way that it is recessed, proceeding from back part 7 of the clamping spring up to below a contact plane, which is defined by the extension of contact branch 6.

In many cases, contact branch 6 lies plane-parallel on the upper surface 17 of the bus bar, so that the named contact plane can coincide with contact surface 17 of the bus bar. In the example of embodiment that is shown, however, contact branch 6 is shaped in such a way that it is applied to the underside of back part 7 of the clamping spring when the clamped connection 22*a* is opened (see the clamped connection in FIG. 1 for this purpose). As can be seen in FIG. 1, contact branch 6 defines a plane, shown by dashed line 24 on clamp connection 22*b*. The clamp spring 4 is designed such that at least a majority of, and preferably, the entire curved spring piece or bow 9 lies on one side of the plane 24 and the back part 7 of the clamping branch 8 lies on the opposite side of the plane 24. This configuration also enables the back part 7 of the clamping branch 8 to lie in a plane which is substantially parallel to the plane 24 when the clamping spring is in the open position, as shown by clamped connection 22*a* in FIG. 1.

According to the instructions of the invention, the bus bar is adapted to the recessed curved spring piece 9 of the clamping spring in such a way that bus bar 5 has a recess or, e.g., shaped cavity 18 in the region of curved spring piece 9, and the curved spring piece 9 of the clamping spring is arranged in a recessed position in this cavity 18. Considered in the plane of the contact surface 17 of the bus bar, the lowering of the bus bar is indicated by the freely cut end of upper surface 17 of the bus bar, so that curved spring piece 9 is lowered behind this freely cut end into shaped cavity 18 present in side cheek 19 of the bus bar.

It can be seen from the presentation in FIG. 1 that the structural height of the clamped connection measured crosswise to direction 13 for introducing the conductor is very small in the plane of the drawing. Both in the closed as well as in the opened position of the clamped connection, its structural height is always smaller than the structural dimensions that are necessary for the conductor opening 13 and the actuation opening 14. This is true even if the conductor opening 13 and the actuation opening 14 are arranged very close to one another, as is shown in FIG. 1.

What is claimed is:

1. A spring-loaded clamping connection for electrical conductors comprising:

a bus bar; and a clamping spring which is mounted on said bus bar, said clamping spring having a contact branch and a clamping branch, said clamping branch including a vertical portion and a horizontal portion, said contact branch and said clamping branch being interconnected by a bow portion of said clamping spring;

wherein said horizontal portion of said clamping branch includes a clamping aperture for receiving a conductor therein, said aperture including first and second parallel edges;

said bus bar including a head portion which extends through said clamping aperture, wherein said first edge of said clamping aperture is normally urged toward said head portion by said bow portion of said clamping spring, thereby forming a clamping area between said first edge of said clamping aperture and said head portion;

wherein said contact branch defines a plane, and at least a majority of said bow portion lies on one side of said plane and said clamping branch lies on an opposite side of said plane.

2. The spring-loaded clamping connection of claim 1, wherein said bus bar includes a recess which is constructed and arranged for receiving at least a portion of said bow portion of said clamping spring.

3. The spring-loaded clamping connection of claim 2, wherein, when said clamping branch is urged toward said contact branch, said first edge of said clamping aperture is moved away from said head portion of said bus bar, thereby opening said clamping area between said first edge of said clamping aperture and said head portion of said bus bar to enable a conductor to be inserted therein.

4. The spring-loaded clamping connection of claim 3, wherein, when said clamping branch is urged against said contact branch, said vertical portion of said clamping branch lies in a plane which is substantially parallel to the plane defined by said contact branch.

5. A spring-loaded clamping connection for electrical conductors comprising:

a housing;

a bus bar mounted within said housing; and a clamping spring which is mounted on said bus bar, said clamping spring having a contact branch and a clamping branch, said clamping branch including a vertical portion and a horizontal portion, said contact branch and said clamping branch being interconnected by a bow portion of said clamping spring;

wherein said horizontal portion of said clamping branch includes a clamping aperture for receiving a conductor therein, said aperture including first and second parallel edges;

said bus bar including a head portion which extends through said clamping aperture, wherein said first edge of said clamping aperture is normally urged toward said head portion by said bow portion of said clamping spring, thereby forming a clamping area between said first edge of said clamping aperture and said head portion;

said housing including a mounting core, said bow portion being constructed and arranged to encircle at least 180° of a surface of said mounting core.

6. The spring-loaded clamping connection of claim 5, wherein said bus bar includes a recess which is constructed and arranged for receiving at least a portion of said bow portion of said clamping spring.

7. The spring-loaded clamping connection of claim 6, wherein, when said clamping branch is urged toward said contact branch, said first edge of said clamping aperture is moved away from said head portion of said bus bar, thereby opening said clamping area between said first edge of said clamping aperture and said head portion of said bus bar to enable a conductor to be inserted therein.

8. The spring-loaded clamping connection of claim 7, wherein, when said clamping branch is urged against said contact branch, said vertical portion of said clamping branch lies in a plane which is substantially parallel to a plane defined by said contact branch.

* * * * *